US009049942B2

(12) United States Patent
Huang

(10) Patent No.: US 9,049,942 B2
(45) Date of Patent: Jun. 9, 2015

(54) MOVABLE BED

(71) Applicant: Frank Huang, Minsyong Township, Chiayi County (TW)

(72) Inventor: Frank Huang, Minsyong Township, Chiayi County (TW)

(73) Assignee: Apex Health Care Mfg. Inc., Chiayi County (TW)

( * ) Notice: Subject to any disclaimer, the term of this patent is extended or adjusted under 35 U.S.C. 154(b) by 0 days.

(21) Appl. No.: 14/071,710

(22) Filed: Nov. 5, 2013

(65) Prior Publication Data

US 2015/0121623 A1 May 7, 2015

(51) Int. Cl.

*A47C 20/04* (2006.01)
*A61G 7/015* (2006.01)
*A61G 7/018* (2006.01)

(52) U.S. Cl.

CPC ..... *A47C 20/041* (2013.01); *A61G 7/015* (2013.01); *A61G 7/018* (2013.01)

(58) Field of Classification Search

CPC ..... A61G 7/015; A61G 7/018; A61G 7/012; A61G 13/08; A47C 20/041; A47C 20/08; A47C 20/12

USPC ..... 5/613, 614, 616–618

See application file for complete search history.

(56) References Cited

U.S. PATENT DOCUMENTS

| | | | | | |
|---|---|---|---|---|---|
| 2,560,689 | A * | 7/1951 | Dorton | 5/140 |
| 3,681,792 | A * | 8/1972 | Korber | 5/618 |
| 3,686,696 | A * | 8/1972 | Lanigan | 5/611 |
| 4,361,917 | A * | 12/1982 | Wilson | 5/616 |
| 4,381,571 | A * | 5/1983 | Elliott | 5/616 |
| 5,090,071 | A * | 2/1992 | Bathrick et al. | 5/618 |
| 5,537,701 | A * | 7/1996 | Elliott | 5/617 |
| 5,608,932 | A * | 3/1997 | Hasegawa | 5/611 |
| 6,006,379 | A * | 12/1999 | Hensley | 5/618 |
| 6,276,011 | B1 * | 8/2001 | Antinori | 5/618 |
| 6,393,641 | B1 * | 5/2002 | Hensley | 5/618 |
| 6,702,305 | B2 * | 3/2004 | Miles | 280/32.6 |
| 6,851,144 | B2 * | 2/2005 | Wang | 5/610 |
| 6,908,154 | B2 * | 6/2005 | Aono | 297/330 |
| 7,293,309 | B1 * | 11/2007 | Shih et al. | 5/618 |
| 7,448,100 | B1 * | 11/2008 | Shih | 5/600 |
| 7,530,125 | B2 * | 5/2009 | Neuenswander | 5/616 |
| 7,559,102 | B1 * | 7/2009 | Benzo et al. | 5/618 |
| RE43,155 | E * | 2/2012 | Allen et al. | 5/618 |
| 8,615,827 | B2 * | 12/2013 | Newkirk et al. | 5/602 |
| 2001/0000828 | A1 * | 5/2001 | Hensley | 5/618 |
| 2002/0189015 | A1 * | 12/2002 | Barssessat | 5/620 |
| 2004/0034934 | A1 * | 2/2004 | Weinman et al. | 5/618 |
| 2004/0194213 | A1 * | 10/2004 | Weinman et al. | 5/618 |

(Continued)

*Primary Examiner* — Nicholas Polito
*Assistant Examiner* — Eric Kurilla
(74) *Attorney, Agent, or Firm* — Alan D. Kamrath; Kamrath IP Lawfirm, P.A.

(57) ABSTRACT

A movable bed contains a base, a moving assembly, a first electric actuator, a second electric actuator, a driving shaft for matching with a support stand, and a lifting rack. The moving assembly includes four rollers fitted into two rails of the base. The base includes a centrally horizontal rod with a U-shaped piece. A top end of the first electric actuator is rotatably coupled with a connecting piece of the driving shaft, and the driving shaft has two ends connecting with the support stand and two U-shaped pieces. The second electric actuator includes a bottom end fixed on the moving assembly and a top end rotatably coupled with a L-shaped piece of a first plate of the lifting rack, one end of the first plate is rotatably joined with a second plate. The second plate is rotatably connected with a pushing bar also rotatably joined with the moving assembly.

1 Claim, 7 Drawing Sheets

(56) References Cited

U.S. PATENT DOCUMENTS

| | | | | |
|---|---|---|---|---|
| 2005/0076440 | A1* | 4/2005 | Taguchi et al. | 5/618 |
| 2005/0102754 | A1* | 5/2005 | Barthelt | 5/618 |
| 2005/0278850 | A1* | 12/2005 | Weinman et al. | 5/618 |
| 2006/0059621 | A1* | 3/2006 | Poulos et al. | 5/430 |
| 2006/0085913 | A1* | 4/2006 | Kawakami et al. | 5/618 |
| 2007/0157387 | A1* | 7/2007 | Mossbeck | 5/618 |
| 2007/0234477 | A1* | 10/2007 | Dorenbeck | 5/618 |
| 2008/0000027 | A1* | 1/2008 | Clenet | 5/618 |
| 2008/0028535 | A1* | 2/2008 | Rodrigues Moreira | 5/722 |
| 2008/0276373 | A1* | 11/2008 | Clenet | 5/618 |
| 2009/0019640 | A1* | 1/2009 | Neuenswander | 5/618 |
| 2009/0038074 | A1* | 2/2009 | Barthelt | 5/611 |
| 2009/0094748 | A1* | 4/2009 | Long | 5/613 |
| 2009/0178201 | A1* | 7/2009 | Lujan et al. | 5/618 |
| 2009/0211028 | A1* | 8/2009 | Richmond et al. | 5/618 |
| 2010/0122415 | A1* | 5/2010 | Turner et al. | 5/618 |
| 2010/0199433 | A1* | 8/2010 | Clenet | 5/618 |
| 2010/0325799 | A1* | 12/2010 | Huang | 5/616 |
| 2010/0325800 | A1* | 12/2010 | Huang | 5/618 |
| 2011/0072585 | A1* | 3/2011 | Benzo et al. | 5/618 |
| 2013/0160209 | A1* | 6/2013 | Turner et al. | 5/618 |
| 2014/0041121 | A1* | 2/2014 | Shan | 5/618 |
| 2014/0201916 | A1* | 7/2014 | Ermalovich et al. | 5/618 |
| 2014/0237723 | A1* | 8/2014 | Wysocki et al. | 5/613 |
| 2014/0250599 | A1* | 9/2014 | Cassell et al. | 5/613 |
| 2014/0250600 | A1* | 9/2014 | McCarty et al. | 5/617 |

* cited by examiner

MOVABLE BED

FIELD OF THE INVENTION

The present invent relates to a movable bed which helps a user to take objects on a bedside cabinet of the movable bed easily.

BACKGROUND OF THE INVENTION

A conventional bed is fixed, so when a user sits on the bed to read book or watch TV, he/she has to put a pillow behind the waist or leans against a bedside cabinet so as to support the waist. Such a conventional bed cannot be adjusted toward a desired angle randomly. Moreover, a fatigue will cause after sitting on the bed for a long time.

A rollaway bed is therefore developed so that the user can adjust a sitting angle, however, when the user sits on the rollaway bed by lifting a front plate, he/she moves away from the bedside cabinet without taking objects on the bedside cabinet easily.

With reference to FIGS. 1 and 2, a rollaway bed for moving close to a wall contains a base 10, a front support stand 11, a driving rack 12, a rear support stand 13, and a lifting frame 14. In addition, a mattress 15 is fixed on the front support stand 11, the driving rack 12, the rear support stand 13, and the lifting frame 14. The base 10 includes two rails 101 formed on two sides thereof and used to fit two side rods of the driving rack 12, a connecting shaft 102 is rotatably connected with a respective one of the two rails 101. The front support stand 11 includes a first column 111 arranged on a front end thereof and two second columns 112 fixed on two sides thereof, and between the two second columns 112 is defined a horizontal column 113 from which a first swing arm 114 extending outwardly so as to join with a first drive cylinder 121 on the driving rack 12. The driving rack 12 includes two connection posts 122 disposed on a middle section thereof and coupling with the first drive cylinder 121 and a second drive cylinder 123, and each connecting post 122 has at least one seat 124 secured on an outer side thereof, such that the front support stand 11 is in connection with the rear support stand 13. The driving rack 12 also includes two H-shaped extending holders 125 extending downwardly from a front end and a rear end thereof, and each H-shaped extending 125 has two rollers 126 mounted thereon and at least one coupling member 127 for connecting with a bar 128, such that the driving rack 12 is coupled with the lifting frame 14. The rear support stand 13 and the lifting frame 14 are joined together by ways of at least one pillar 131 and at least one first connector 141, and the lifting frame 14 includes an extending shank 142 formed on a rear end thereof and at least one second connector 143 mounted on the extending shank 142. The rear support stand 13 includes a lateral stem 132 on which a second swing arm 133 is arranged, such that the first drive cylinder 121 is rotatably coupled with the second swing arm 133.

In operation, a front section of the rollaway bed is moved close to the wall to take objects on the bedside cabinet. Nevertheless, such a rollaway bed cannot be slanted toward a desired angle according to using requirement.

The present invention has arisen to mitigate and/or obviate the afore-described disadvantages.

SUMMARY OF THE INVENTION

The primary object of the present invention is to provide a movable bed which helps a user to take objects on a bedside cabinet of the movable bed easily.

Further object of the present invention is to provide a movable bed in which a plurality of supporting panels are adjusted to move toward any desired angle based on using requirement.

Another object of the present invention is to provide a movable bed which is simplified and assembled quickly, and has long service life.

To obtain the above objective, a movable bed provided by the present invention contains: a base, a moving assembly, a first electric actuator, a second electric actuator, a driving shaft for matching with a support stand, and a lifting rack.

The moving assembly is formed in an elongated frame shape and includes four rollers disposed on four lower sides of four downward extending posts thereof and fitted into two rails of the base, such that the four rollers slide in the two rails so as to drive the movable bed to move.

The base includes a centrally horizontal rod on which a U-shaped piece extends outwardly so as to rotatably connect with a bottom end of the first electric actuator.

A top end of the first electric actuator is rotatably coupled with a connecting piece of the driving shaft, and the driving shaft has two ends connecting with the support stand and two U-shaped pieces arranged on one end of the base, such that when a first pushing column of the first electric actuator extends or retracts, the driving shaft is driven by the first pushing column to swing at different angles, and then the support stand is pushed or pulled by the driving shaft to lift or descend.

The second electric actuator includes a bottom end fixed on the moving assembly and a top end rotatably coupled with a L-shaped piece of a first plate of the lifting rack, and one end of the first plate is rotatably joined with a second plate so that the first plate rotates relative to the second plate.

The second plate is rotatably connected with a pushing bar which is also rotatably joined with the moving assembly, such that the second plate is supported by the pushing rod and the moving assembly to lift or descend.

DETAILED DESCRIPTION OF THE PREFERRED EMBODIMENTS

Figure 1:
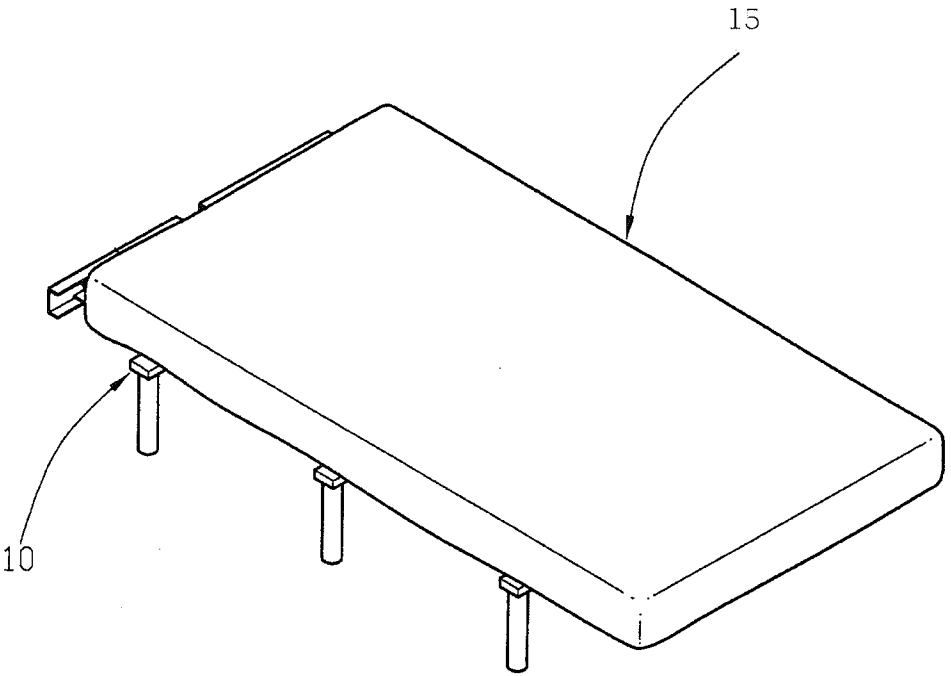
FIG. 1 PRIOR ART
FIG. 1 is a perspective view showing the assembly of a conventional rollaway bed.
Figure 2:
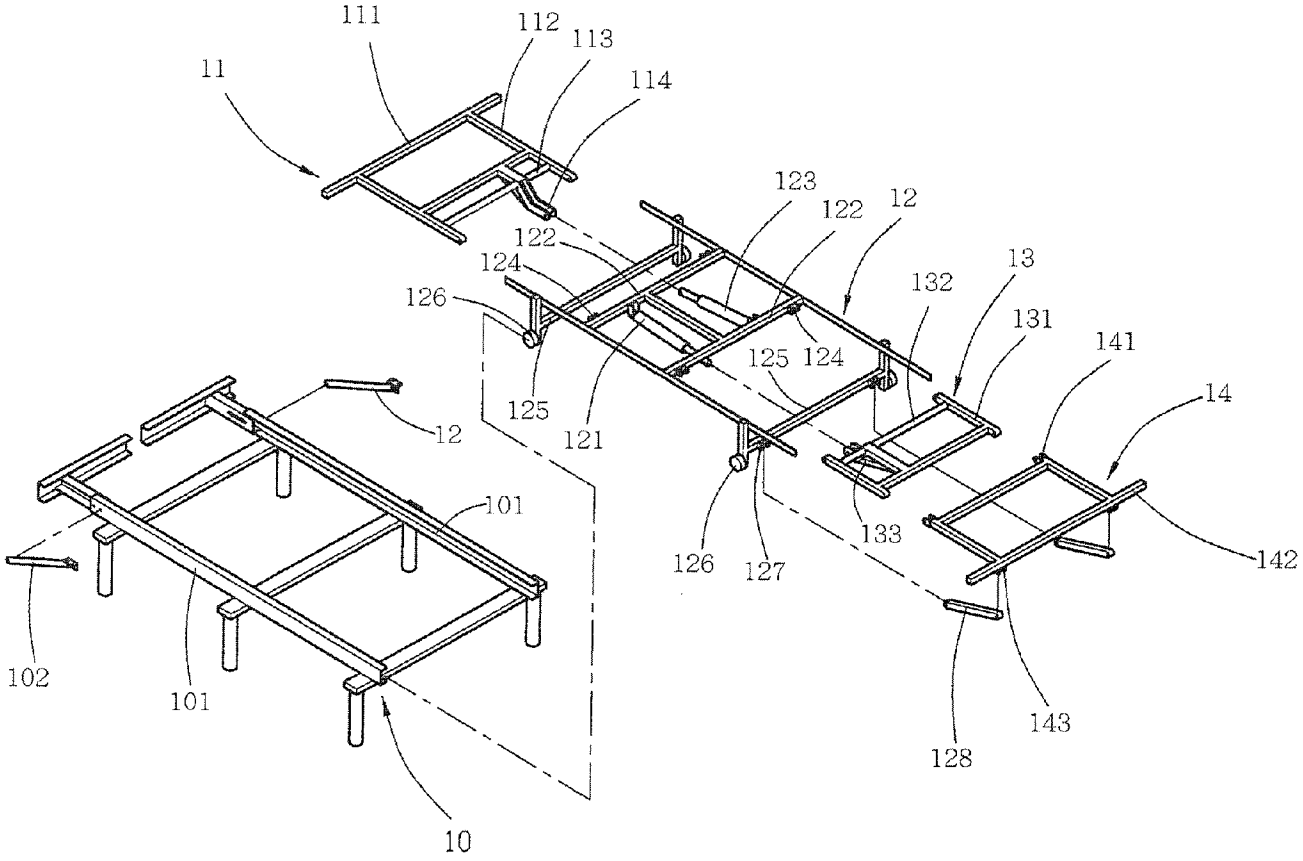
FIG. 2 PRIOR ART
FIG. 2 is a perspective view showing the exploded components of the conventional rollaway bed.
Figure 3:
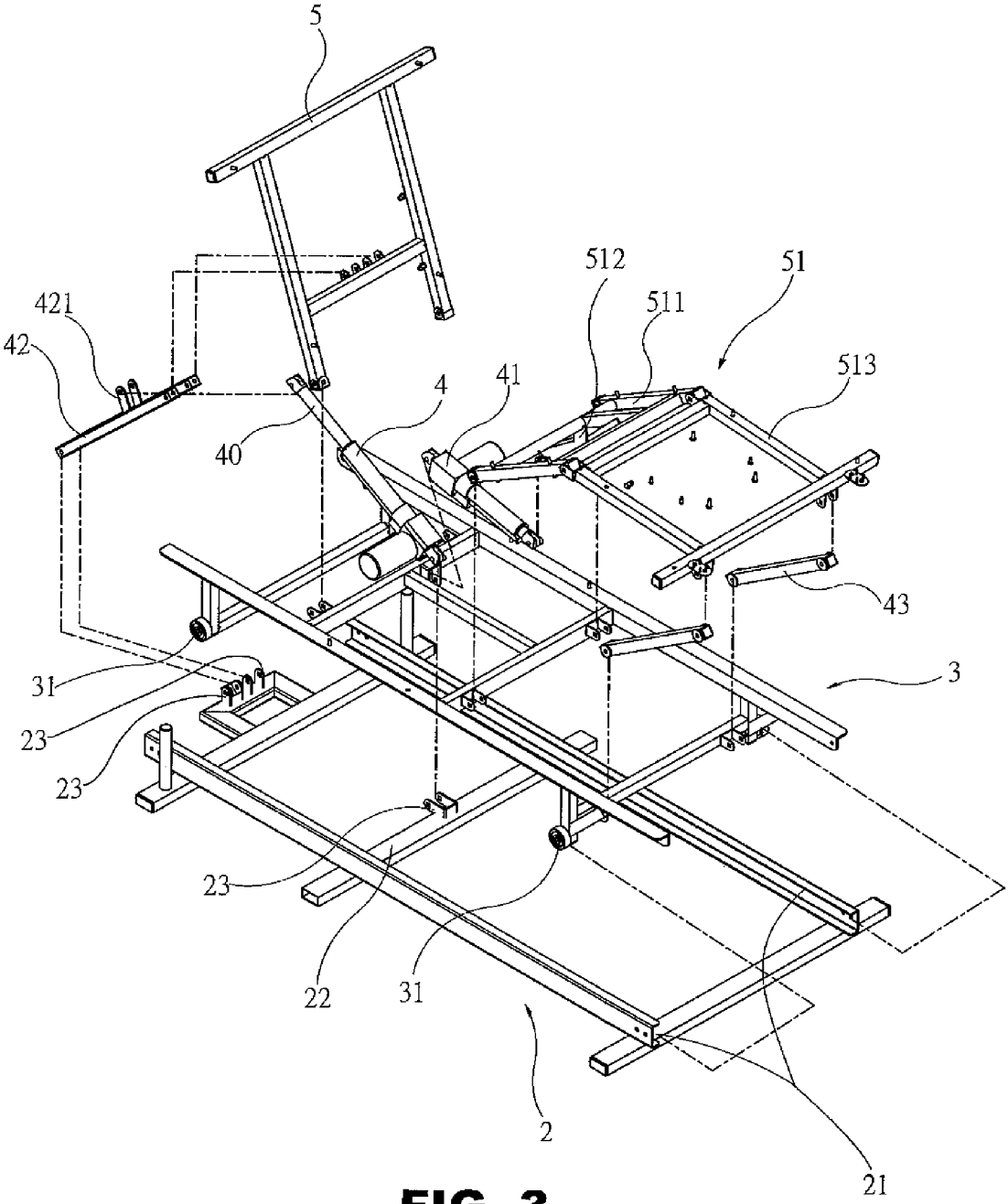
FIG. 3 is a perspective view showing the exploded components of a movable bed according to a preferred embodiment of the present invention.

FIG. 3 is a perspective view showing the exploded components of a movable bed according to a preferred embodiment of the present invention. The movable bed comprises: a base 2, a moving assembly 3, a first electric actuator 4, a second electric actuator 41, a driving shaft 42 for matching with a support stand 5, and a lifting rack 51. The moving assembly 3 is formed in an elongated frame shape and includes four rollers 31 disposed on four lower sides of four downward extending posts thereof and fitted into two rails 21 of the base 2, such that the four rollers 31 slide in the two rails 21 so as to drive the movable bed to move. The base 2 includes a centrally horizontal rod 22 on which a U-shaped piece 23 extends outwardly so as to rotatably connect with a bottom end of the first electric actuator 4. A top end of the first electric actuator 4 is rotatably coupled with a connecting piece 421 of the driving shaft 42, and the driving shaft 42 has two ends connecting with the support stand 5 and two U-shaped pieces 23 arranged on one end of the base 2, such that when a first pushing column 40 of the first electric actuator 4 extends or retracts, the driving shaft 42 is driven by the first pushing column 40 to swing at different angles, and then the support stand 5 is pushed or pulled by the driving shaft 42 to lift or descend. The second electric actuator 41 includes a bottom end fixed on the moving assembly 3 and a top end rotatably coupled with a L-shaped piece 512 of a first plate 511 of the lifting rack 51, and one end of the first plate 511 is rotatably joined with a second plate 513 so that the first plate 511 rotates relative to the second plate 513. The second plate 513 is rotatably connected with a pushing bar 43 which is also rotatably joined with the moving assembly 3, such that the second plate 513 is supported by the pushing rod 43 and the moving assembly 3 to lift or descend.

Figure 4:
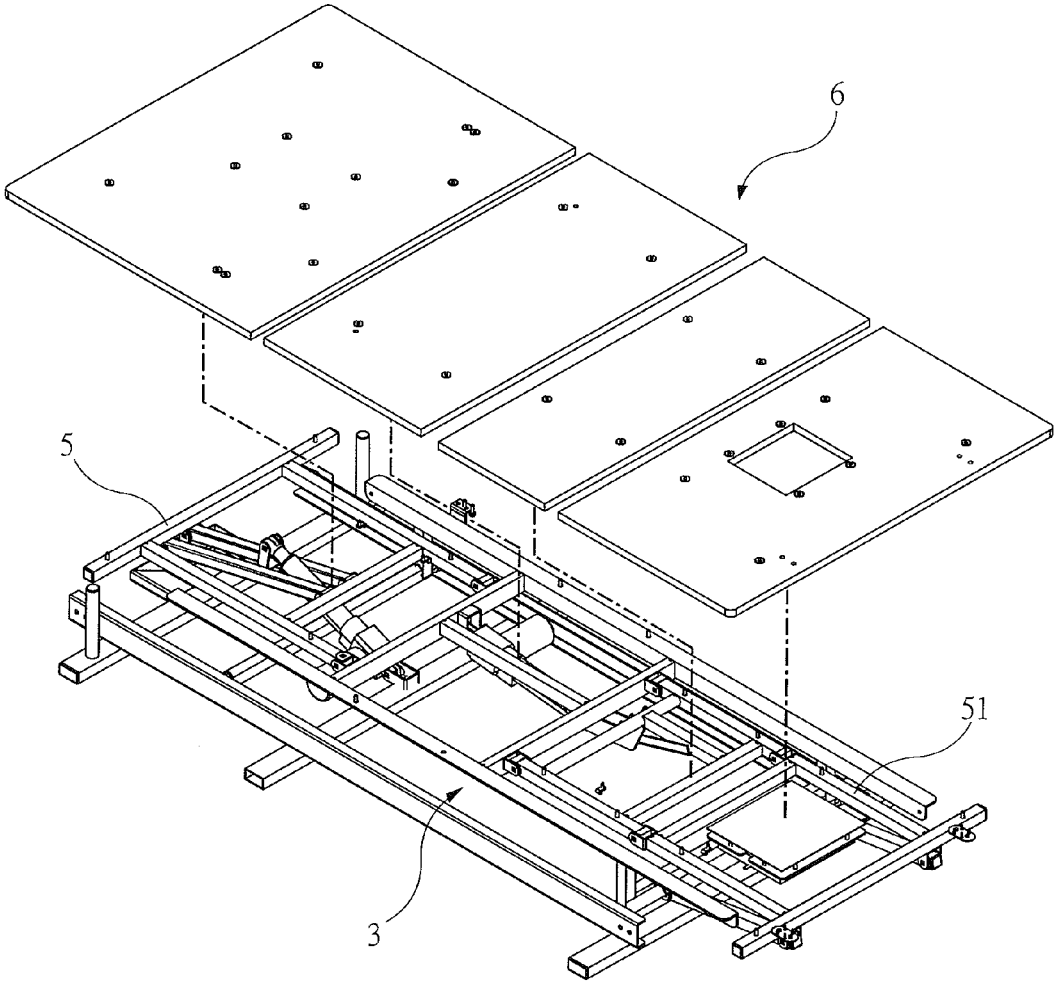
FIG. 4 is a perspective view showing a plurality of supporting panels being placed on the movable bed according to the preferred embodiment of the present invention.

FIG. 4 is a perspective view showing a plurality of supporting panels being placed on the movable bed according to the preferred embodiment of the present invention. After the movable bed is assembled, a plurality of supporting panels 6 are placed on the moving assembly 3 so that a mattress is put on the plurality of supporting panels 6. Thereby, the movable bed moves horizontally, a part of the plurality of supporting panels 6 on a front end of the moving assembly 3 slant, and another part of the plurality of supporting panels 6 on a rear end of the moving assembly 3 lift so that a user takes objects on a bedside cabinet of the movable bed easily. In addition, the plurality of supporting panels 6 are adjusted to move toward any desired angle, and the movable bed is simplified, assembled quickly, and has long service life.

Figure 5:
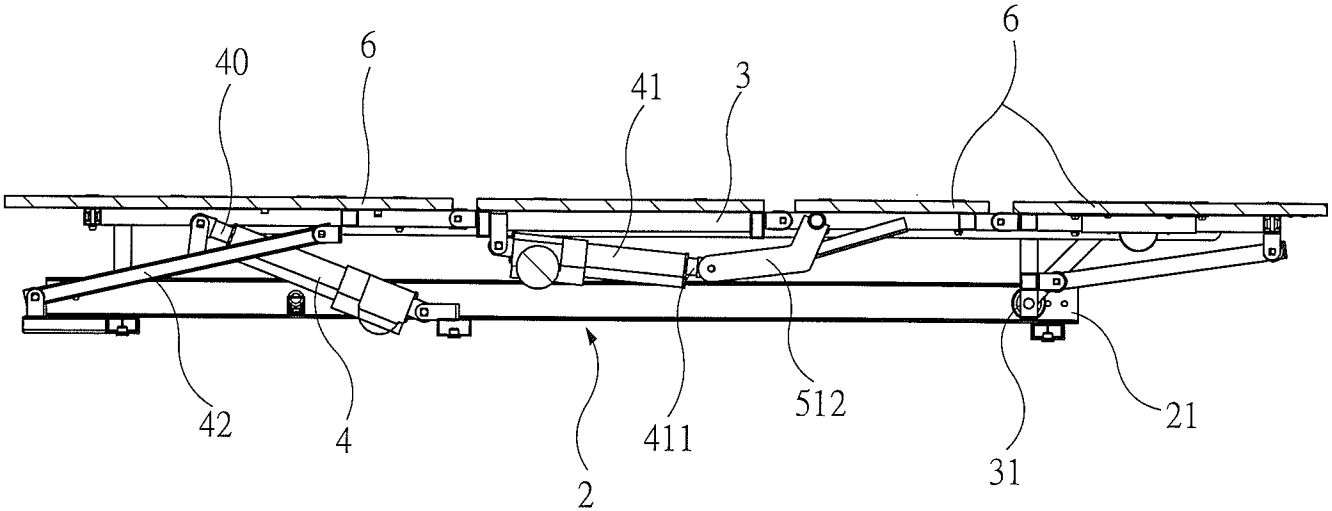
FIG. 5 is a cross sectional view showing the assembly of the movable assembly according to the preferred embodiment of the present invention.

FIG. 5 is a cross sectional view showing the assembly of the movable assembly according to the preferred embodiment of the present invention. In operation, the moving assembly 3 is driven by the driving shaft 42 so that the four rollers 31 of the moving assembly 3 slide in the two rails 21, such that the moving assembly 3 moves horizontally, and a moving distance of the movable bed is adjusted when user moves his/her head upwardly so as to take objects on a cabinet beside the head end of the movable bed.

Figure 6:
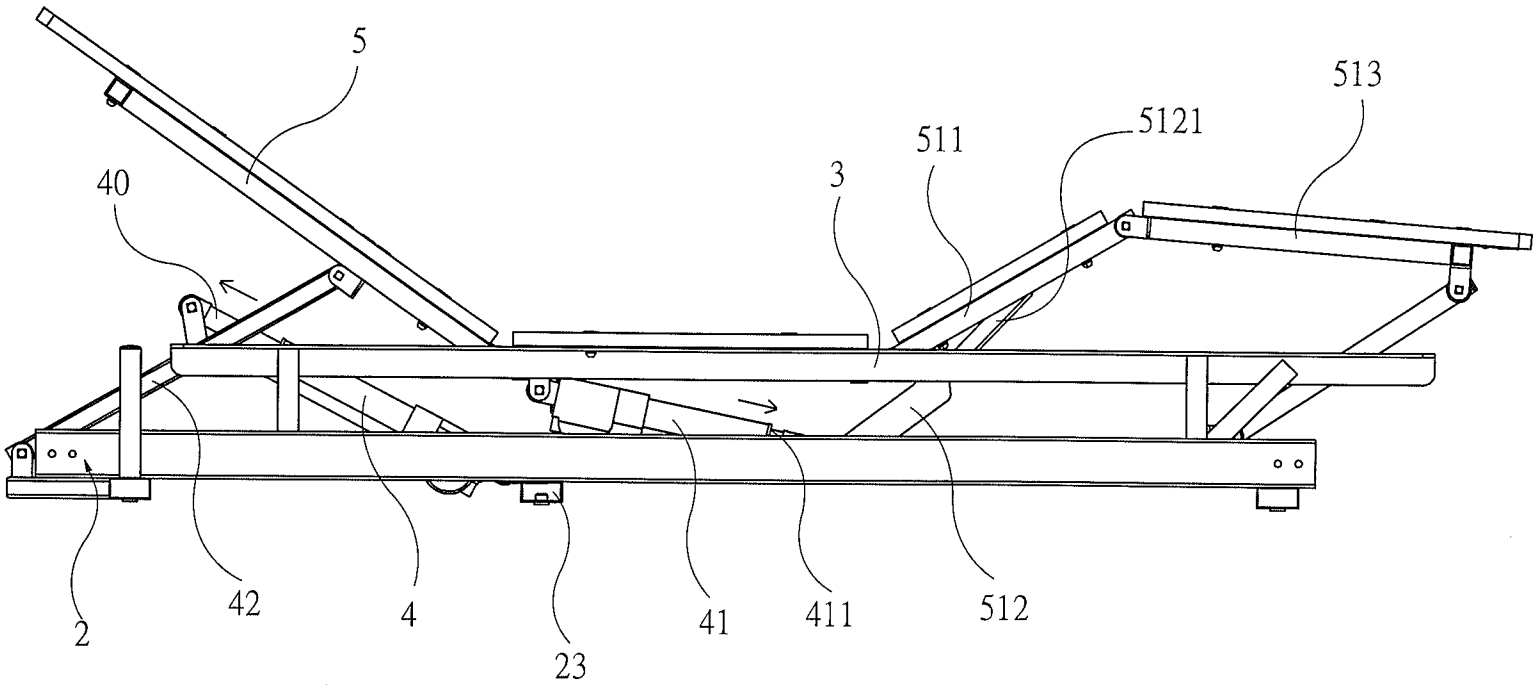
FIG. 6 is a plan view showing the operation of the movable assembly according to the preferred embodiment of the present invention.

Before lifting the movable bed, the first pushing column 40 of the first electric actuator 4 and a second pushing column 411 of the second actuator 41 are retracted in the first actuator 4 and the second actuator 41. When desiring to adjust a tilted angle of a part of the plurality of supporting panels 6 on the front end of the moving assembly 3, the first actuator 4 is started to drive the first pushing column 40 to expand outwardly (as shown in FIG. 6), and the driving shaft 42 is driven by the first pushing column 40 to extend upwardly, hence an angle between the driving shaft 42 and the base 2 increases so that the support stand 5 is pushed by the driving shaft 42 to lift and then it pulls the moving assembly 3 to slide forward. It is to be noted that since the bottom end of the first electric actuator 4 rotatably connects with the U-shaped piece 23 on the centrally horizontal rod 22 of the base 2, the first pushing column 40 of the first electric actuator 4 extends or retracts by using the moving assembly 3 as its fulcrum without interfering a movement of the moving assembly 3, thereby moving the movable bed smoothly.

As illustrated in FIGS. 5 and 6, as desiring to adjust a tilted angle of another part of the plurality of supporting panels 6 on the rear end of the moving assembly 3, the second actuator 41 is started to drive the second pushing column 411 to extend outwardly and downwardly, and then the L-shaped piece 512 of the first plate 511 is pushed by the second pushing column 411, wherein the L-shaped piece 512 has an extending sheet 5121, so when the second pushing column 411 extends outwardly, an angle between the L-shaped piece 512 and the extending sheet 5121 changes, such that the first plate 511 of the lifting rack 51 is lifted to drive the second plate 513 to move upwardly.

Figure 7:
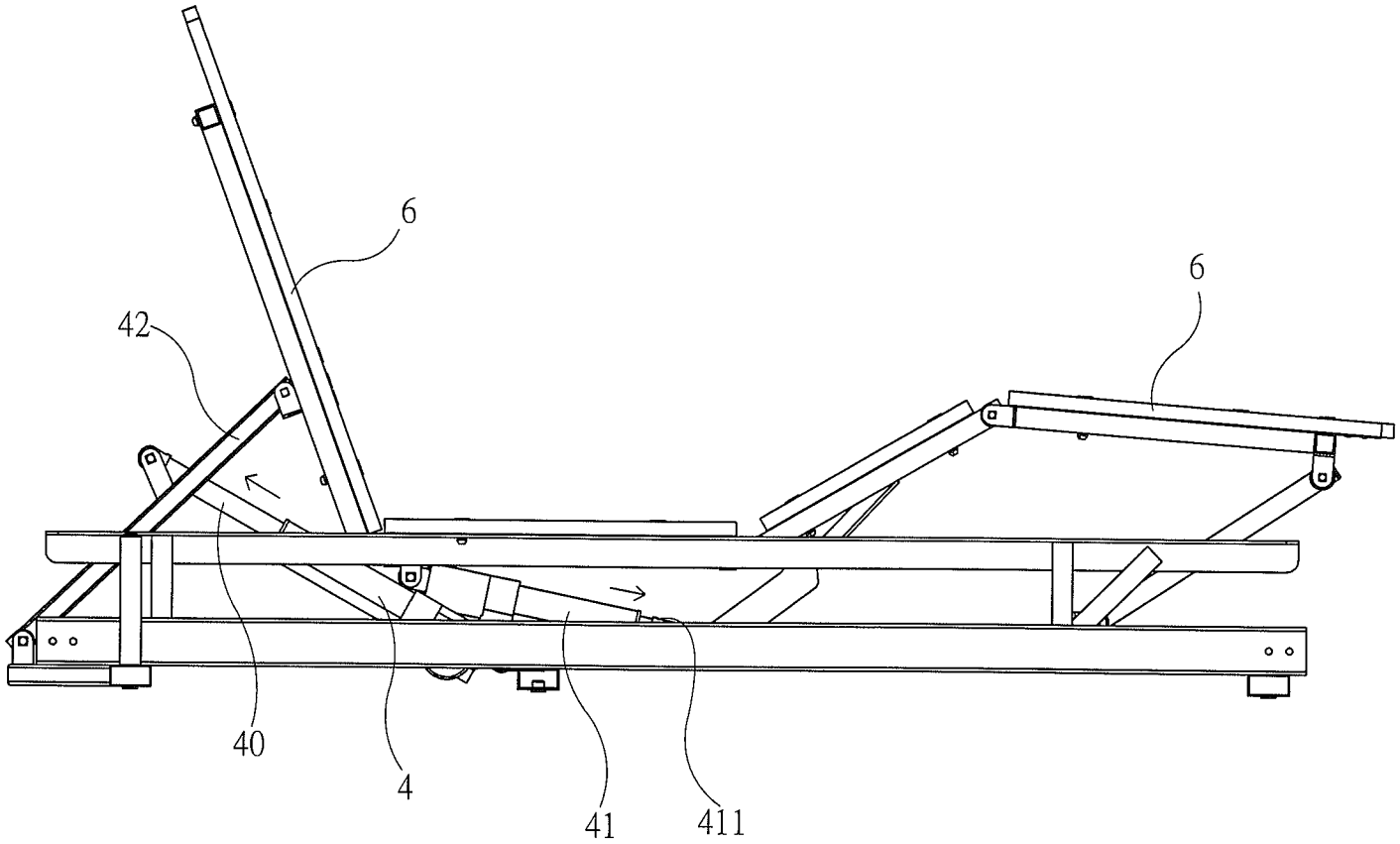
FIG. 7 is another plan view showing the operation of the movable assembly according to the preferred embodiment of the present invention.

Referring further to FIG. 7, when the first pushing column 40 of the first electric actuator 4 and the second pushing column 411 of the second actuator 41 are expended completely, the tilted angle of another part of the plurality of supporting panels 6 on the front end of the moving assembly 3 increases, and the support stand 5 is pulled by the driving shaft 42 to slide forward so that when the user sits on the movable bed, the objects on the bedside cabinet of the movable bed are acquired by the user easily. It is to be noted that the second pushing column 411 is provided to lift another part of the plurality of supporting panels 6 on the front end of the moving assembly 3 completely, thus lifting user's legs to enhance blood circulation.

Thereby, the plurality of supporting panels 6 of the movable bed are adjusted easily to slant at a desired angle, and a moving distance of the movable bed is adjusted when the user moves his/her head upwardly so as to take the objects on the bedside cabinet of the movable bed.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A movable bed comprising a base, a moving assembly, a first electric actuator, a second electric actuator, a driving shaft for matching with a support stand, and a lifting rack;

the moving assembly being formed in an elongated frame shape and including four rollers disposed on four lower sides of four downward extending posts thereof and fitted into two rails of the base, such that the four rollers slide in the two rails so as to drive the movable bed to move; wherein the base includes a centrally horizontal rod on which a U-shaped piece extends outwardly from a central position of the centrally horizontal rod so as to rotatably connect with a bottom end of the first electric actuator;

a top end of the first electric actuator is rotatably coupled with a connecting piece of the driving shaft, and the driving shaft has two ends connecting with the support stand and two U-shaped pieces arranged on one end of the base, such that when a first pushing column of the first electric actuator extends or retracts, the driving shaft is driven by the first pushing column to swing at different angles, and then the support stand is pushed or pulled by the driving shaft to lift or descend;

the second electric actuator includes a bottom end fixed on the moving assembly and a top end rotatably coupled with a L-shaped piece of a first plate of the lifting rack, one end of the first plate is rotatably joined with a second plate so that the first plate rotates relative to the second plate; and the second plate is rotatably connected with a pushing bar which is also rotatably joined with the moving assembly, such that the second plate is supported by the pushing rod and causing the moving assembly to lift or descend.

* * * * *